US005302425A

United States Patent [19]

Taylor

[11] Patent Number: 5,302,425

[45] Date of Patent: * Apr. 12, 1994

[54] RIBBON TYPE SPACER/SEAL SYSTEM

[76] Inventor: Donald M. Taylor, 3844 Sundown Dr., Nanaimo, B.C., Canada, V9T 4H5

[ * ] Notice: The portion of the term of this patent subsequent to Mar. 1, 2011 has been disclaimed.

[21] Appl. No.: 925,537

[22] Filed: Aug. 5, 1992

Related U.S. Application Data

[63] Continuation-in-part of Ser. No. 609,336, Nov. 5, 1990, which is a continuation-in-part of Ser. No. 366,069, Jun. 14, 1989, abandoned.

[51] Int. Cl.[5] ..... E06B 3/24

[52] U.S. Cl. ..... 428/34; 428/137; 428/167; 428/172; 428/192; 52/790

[58] Field of Search ..... 428/34, 131, 137, 167, 428/172, 156, 121, 192; 52/171, 172, 788–790; 156/107, 109

[56] References Cited

U.S. PATENT DOCUMENTS

| | | | |
|---|---|---|---|
| 3,280,523 | 10/1966 | Stroud et al. | 52/172 |
| 3,314,204 | 4/1967 | Zopnek | 52/308 |
| 3,935,683 | 2/1976 | Derner et al. | 52/172 |
| 3,965,638 | 6/1976 | Newman | 52/616 |
| 4,015,394 | 4/1977 | Kessler | 52/616 |
| 4,109,431 | 8/1978 | Mazzoni et al. | 52/172 |
| 4,113,905 | 9/1978 | Kessler | 428/34 |
| 4,198,254 | 4/1980 | Laroche et al. | 156/107 |
| 4,222,213 | 9/1980 | Kessler | 52/790 |
| 4,226,063 | 10/1980 | Chenel | 52/172 |
| 4,531,609 | 7/1985 | Wolf et al. | 428/167 |
| 4,564,540 | 1/1986 | Davies et al. | 428/34 |
| 4,576,841 | 3/1986 | Lingemann | 428/34 |
| 4,649,685 | 3/1987 | Wolf et al. | 52/398 |
| 4,658,553 | 4/1987 | Shinagawa | 52/172 |
| 4,719,728 | 1/1988 | Eriksson et al. | 52/172 |
| 5,079,054 | 1/1992 | Davies | 428/35.8 |

FOREIGN PATENT DOCUMENTS

| | | |
|---|---|---|
| 0261923 | 3/1988 | European Pat. Off. . |
| 0328823 | 8/1989 | European Pat. Off. . |
| 3044179 | 3/1982 | Fed. Rep. of Germany . |
| 7010731 | 1/1972 | Netherlands . |
| 7306358 | 11/1973 | Netherlands . |
| 2181773 | 4/1987 | United Kingdom . |

*Primary Examiner*—Donald J. Loney
*Attorney, Agent, or Firm*—Caesar, Rivise, Bernstein, Cohen & Pokotilow, Ltd.

[57] ABSTRACT

A window spacer system for multi-paned window and door lights uses a paper or carboard substrate, generally built up in laminated ribbon structure as a low cost hermetic seal possessing unusual thermal insulating and thermal expansion characteristics. The ribbon may be impregnated or laminated with superior sealants, including polyvinyl alcohol and SARAN (TM) and can be scored or marked for folding into hollow seal sections, from which a peripheral seal frame can be readily manufactured. Metallic foil, in a range of thickness can be incorporated, to enhance the sealing characteristics, and in certain instances to provide a dead-fold characteristic to the seal ribbon.

30 Claims, 6 Drawing Sheets

RIBBON TYPE SPACER/SEAL SYSTEM

This is a Continuation-in-Part of application Ser. No. 07/609,336 filed Nov. 5, 1990; itself a Continuation-in-Part of application Ser. No. 07/366,069 filed Jun 14, 1989, now abandoned.

TECHNICAL FIELD

The invention is directed to insulated spacer systems for use in fabricating multi-paned lights.

BACKGROUND ART

The manufacture of multi-paned window lights for use in the glazing of windows and doors requires that a controlled insulative distance be kept between the adjacent glazing panel panes. Ideally, this gap distance should be defined by a peripheral frame, which is hermetically sealed to the spaced apart panes thus creating a confined "dead air" space, which may optionally be filled with an improved insulative gas.

Such spacer frames have usually been roll-formed, using tubular type aluminum profile sectioned frame materials, the hollow interior of which frequently serves to contain moisture vapor desiccants, for the removal of any moisture that may be present within the sealed construction. While such metal spacers form an effective moisture vapor barrier, they also possess high thermal conductivity characteristics, with a conductivity coefficient "k" value in excess of 117 which can create a thermal bridge between the panes being separated unless thermally isolated or "broken". Such thermal bridges can lead to the accumulation of moisture, as condensation and frost on surfaces of the glazing panel adjacent the seals, at the panel periphery. Such accumulations are undesirable aesthetically as well as being potentially destructive to adjoining structures, due to staining and moisture damage.

While the provision of an intermediate thermal break can enhance the insulative performance of such metallic seal, such constructions are expensive, costing as much per lineal foot as ninety cents (Canadian).

Thermally insulative spacers have been made from thermosetting and thermoplastic materials by the pulltrusion or by extrusion process, which spacers have overcome the thermal insulative problem, but have failed to durably respond to the sealing requirements of low gas permeability and resistance to sunlight degradation due to the action of ultra-violet light energy, and their use has led to internal "fogging" of the glazing panel due to outgassing of hydrocarbon vapours from the plastics used, which vapours can condense on the internal faces of the inner and/or outer panes. The developing use of special glazing glasses has tended to exacerbate ultra-violet degradation by tending to reflect and build up the ultra-violet level.

The use of oriented sheet plastics material in forming a seal section, in order to achieve high impermeability against gas or moisture penetration, encounters problems when thermal conditions are such that the material annealing temperature is reached. At such temperatures mechanical stresses as high as, and often over 14000 pounds per square inch may be released as the spacer material returns to its pre-oriented condition.

Other known spacers include those having a stabilizing aluminum core and a body of mastic type compound. The core is susceptible to thermal bridging.

Sponge like cellular silicones present problems of permeability, structural integrity and require mechanical support.

It will be further understood that, in addition to thermal insulation and gas encapsulation and retention performance, which are particularly important, the requirement also exists for practical, low cost, effective spacers that require a minimum of waste during fabrication, lend themselves to ready formation and installation, and which provide for the incorporation of absorbents for moisture vapor and other hydrocarbon gases, to extend the service life span of a sealed, insulative glazing panel.

Various aspects of the prior art are to be found in the following United States patents which are directed to multi-paned window systems and components thereof.

| | | |
|---|---|---|
| 49,167 | August 1865 | Stetson |
| 3,314,204 | April 1967 | Zopnek |
| 3,280,523 | October 1966 | Stroud et al. |
| 4,015,394 | April 1977 | Kessler |
| 4,109,431 | August 1978 | Mazzoni et al. |
| 4,658,553 | April 1987 | Shingawa |
| 4,719,728 | January 1988 | Erikson et al. |
| 4,649,685 | March 1987 | Wolf et al. |
| 4,567,841 | March 1986 | Lingemann |
| 4,564,540 | January 1986 | Davies et al. |
| 4.226,063 | October 1980 | Chenel |
| 4,222,213 | September 1980 | Kessler |
| 4,113,905 | September 1978 | Kessler |
| 4,198,254 | April 1980 | Laroche et al. |
| 3,965,638 | June 1976 | Newman |
| 3,935,683 | February 1976 | Derner et al. |

In various solutions, ranging from Stetson to Derner et al., various aspects of spacer provisions, and of their respective limitations may be fairly readily identified by those skilled in the art.

In addition to avoiding undesireable complexity, the costing aspects of each spacer system must be born in mind as well as the need to achieve a reliable sealing life expectancy for the spacer. An established, long term life of several years duration is required to prove seal effectiveness. Anything less is commercially unacceptable.

A further, highly significant aspect of any spacer system is its suitability for assembling into window units. Factors such as ease of handling; handling robustness; longitudinal and lateral stiffness; ease of cutting to length and facility for forming joints, particularly corner joints; seal component compatability for receiving adhesives on selected surfaces, are all relevant factors in determining the suitability of a seal/spacer system.

Thus, for example, in the case of pultruded, glass reinforced plastic sections, these are generally of considerable thickness, which complicates corner formation, upon making-up a seal "frame". They are also a comparatively high cost item.

Thus, to sum up the various aspects of a seal system, it should be born in mind that an ideal spacer system should be of low cost; should possess extremely high resistance to gas percolation therethrough; be suitably constituted to traverse the corners of the panes; possess high resistance to degradation; be laterally flexible, readily applied, and effectively adhered and edge-sealed; structurally stable; of sufficient mechanical strength for installation; and possessing a low edge-to-edge thermal conductivity factor.

DISCLOSURE OF INVENTION

The present invention provides a novel spacer/seal system for use in sealing multi-layer glazing panels. The subject system is based upon a low cost fibrous substrate to provide a peripheral diaphragm enclosing the interior periphery of a pair of glazing panels.

The fibrous substrate possesses, effectively, a zero thermal expansion coefficient; is an extremely poor thermal conductor; and due to its porosity and controllable surface finish can be impregnated with selected sealing substances, or may be coated or laminated therewith. The dimensionally stable substrate is substantially stress free over temperatures in the range of −60° C. to 300° C., or to its auto-ignition temperature.

The fibrous substrate, in the form of paper or cardboard can be laminated to desired thicknesses to provide satisfactory strength as a spacer in holding the opposed glazing panes in spaced apart relation.

In one embodiment the fibrous peripheral diaphragm may be combined with a sealant, by way of coating, lamination or impregnation, so as to provide, in use, a peripheral hermetic seal adequate to withstand the passage of air, water vapour, noble gases or evolved vapour for an extended period of years.

In a further embodiment, the peripheral substrate, in a substantially porous condition may be secured in place as a spacer, the required sealing characteristics for the double glazing panel system being achieved by an encompassing and separate hermetic seal, arranged in enclosing relation with the porous spacer.

Such polymeric materials may be selected from within the families of polyvinylidene (SARAN) chloride, polyvinyl alcohols, polyesters, acetals and/or their copolymers.

In a yet further embodiment the substrate may be thin, and made suitably gas and water vapor impermeable, i.e. "sealed", by coating, lamination or impregnation, the glazing system being completed by an outer peripheral seal about the glazing unit periphery to provide requisite mechanical strength to maintain the structural integrity of the glazing assembly.

Suitable sealants for coating, impregnating or laminating the fibrous substrate include SARAN (TM) or polyvinyl alcohol, acetal polymers or copolymers of such materials.

In preparing laminated spacer/seals the substrate, generally in ribbon form may be printed, creased and/or bent to form a seal section of channel or hollow form, such as a tube or tubes.

In the case of aluminum foil, this can be laminated within layers of the substrate or applied externally thereof. A metal foil sealing element may comprise a continuous layer of metal, generally aluminum, vapour deposited upon a paper or other base. Use of a seal having an external lamina of aluminum generally requires positioning of the metallic layer so as not to form a thermal bridge with the glazing panel portions located adjacent thereto. However, in some instances the capability to deposit an ultra-thin foil layer may effectively reduce the thermal bridging effect to acceptable levels so as to permit direct glass contact without troublesome thermal bridging occurring.

An aluminum laminating layer may be adopted possessing sufficient thickness and associated stiffness to impart a deadfold characteristic to the laminated structure, to facilitate roll-bending or press-bending of a laminated ribbon construction, to form a channel or a closed section. Use of such a relatively thick aluminum layer requires that it be thermally isolated from the glass surfaces of the glazing unit. This is generally achieved by interposing between the glass and the aluminum layer an adequate layer of cardboard or paper or other thermal insulating medium of sufficient thickness to effectively preclude thermal bridging.

The hollow fibre structural nature of these paper and cardboard materials assure excellent insulative properties along with a modulus of stiffness and edgewise compressive strength particularly when laminated to a suitable thickness. Such characterisitics render these materials mechanically suitable for use as materials from which structually sound insulative spacers may be fabricated. A unique property of these materials lie in their ready absorptive reception of liquid resinous materials which can be used to provide moisture and/or gas proofing properties. Furthermore, the materials will accept surface finishes, including glaze, to facilitate subsequent coating and laminate applications.

A single web of cardboard of sufficient thickness prepared in the aforementioned manner may be overlaid with a thin metal foil, decorative paper or plastic film, or may be overprinted via silk screening, offset or gravure printing methods, This cardboard web may now be scored or creased, than folded to form a hollow rectangular or other tubular geometric shape. A spacer configured in this manner can be fabricated into a frame enclosure by adhesive bonding or by mechanical fastening of the joint and corners. Spacers made in this matter are low cost, have excellent insulative value, are thermally stable and do not pose problems of outgassing, yet provide an impermeable barrier to the passage of moisture vapor and noble gasses therethrough.

Thinner cardboard or paper, treated in the aforementioned manner may be adhesively laminated together to form a laminated web of the required structural strength, then scored or creased and folded to a form or sectional shape in the same manner as a single web. There are advantages to this multi-layer laminated web which enhance the barrier qualities of the spacer and permit the use of an inner laminate layer of untreated paper or light cardboard, preprinted and/or decoratively embossed.

In yet another version of the subject structural cardboard/paper spacer, a web of cast or extruded polyvinyl alcohol barrier film may be adhesively laminated thereto to form an interior laminate web portion, with the cardboard either treated or untreated forming the exterior structural faces. Similarly, a SARAN (TM) web may be substituted and incorporated in a like manner.

A yet further approach contemplates a paper or thin cardboard seal, in combination with an adjoining edge spacer. The composite cardboard or paper seal in association with appropriate sealing and U.V. resistant laminates impregnated or laminated thereto provides a flexible, hermetic seal. An adjacent surrounding seal provides complementary mechanical strength to secure the adjacent glazing panes in spaced relation. Such an arrangement requires the provision of special assembly fixtures wherein the flexibility and low stiffness coefficient of the seal are temporarily augmented by the fixture, until the surrounding seal is applied, to provide the required mechanical strength.

While the aforementioned and following descriptions form a general outline of the method of producing a structural paper or cardboard bodied spacer, while describing the principles of spacers and the scope of the possible variations and options, these spacers are not confined by nor limited to the specifics so outlined.

The present invention provides a multi-layer glazing panel separation system incorporating, or to which may be applied a seal means to provide a hermetic seal between opposed, substantially parallel gas impermeable glazing panels, the seal comprising: an elongated ribbon-like section of low cost insulative fibrous substrate material such paper and/or cardboard of predetermined transverse width and lateral edge-to-edge load bearing capacity and low thermal conductivity; a barrier layer of substantially gas impermeable and ultraviolet degradation resistant material on at least one transverse portion of the section to substantially preclude on a long-term basis the percolation of benign gases and air therethrough; and edge means for securing the seal in edge sealed relation to adjoining portions of a respective window pane.

In one embodiment of the invention there is provided a composite tubular insulative spacer for the precision separation of glazing panels in substantially mutually parallel relation, comprising a fibrous substrate having a coefficient of thermal expansion compatible in use with the glazing panels, the substrate being faced with an overcladding layer of gas impermeable organic barrier such as polyvinyl alcohol or polyvinylidene chloride, and material preferably selected from the group comprising polyvinyl alcohol, polyvinylidene chloride, thermoplastic polyesters, acetals and ethylene vinyl alcohol copolymers and combinations thereof applied to selected surfaces of the substrate.

The subject spacer may be economically provided as a ribbon of predetermined width, foldable laterally into a plurality of longitudinally extending narrow panels, to form a fabricated spacer section; the spacer section when formed having at least one of the panels lying in a plane normal to the plane of the fabricated spacer frame, at least one face of the panel comprising edge to edge seal diaphragm means in gas and vapour hermetic sealing relation, the ribbon panels being of predetermined stiffness, laterally, whereby in use the spacer section possesses predetermined values of lateral stiffness and low edge-to-edge thermal conductivity. In a number of embodiments of the invention a plurality of longitudinal fold lines may be provided, to facilitate lateral folding of the ribbon to form the spacer section, the fold lines extending substantially parallel, longitudinally of the ribbon. The fold lines generally comprise indentations wherein the thickness of the ribbon section is locally diminished.

A range of low cost fibrous substrate materials possessing the requisite strength and formability characteristics may be used, including paper, cardboard and Keyes (T.M.) fiber board.

Owing to its porosity, paper and cardboard are readily impregnated with coating materials of superior sealing capability. Paper is available in a range of thickness and in rolls of such length as to be considered substantially continuous. Cardboards, in thickness ranging from four point to as much as sixty point and higher, are also available in rolls up to 1000 feet continuous length.

In order to achieve desired mechanical strength it will be understood that paper and cardboard are readily laminated to described thicknesses. In some instances the sealing material, such as SARAN (TM) may also form the laminating adhesive, in building up a composite spacer.

An extruded or cast barrier film such as polyvinyl alcohol may also be adhered to coat or to laminate a paper or cardboard web, in forming a spacer/seal.

Cardboard is readily available in mill roll form, up to 1000 feet continuous length. A reflective and sealing diaphragm may include aluminum foil of 0.001 inches or less, possibly laminated with or vapour deposited on a paper or a SARAN (TM) thermoplastic base. Other sealant foil materials may comprise tin foil, lead foil, and even gold foil. A thicker metallic foil may be used to convey both sealing and dead-fold characteristics.

A reflective diaphragm may be applied to the portion of the substrate forming the spacer surface enclosing the inner periphery of the glazing panel, generally being slightly undersized to avoid formation of a thermal bridge between the two glazing panels. It will be understood that the sealing diaphragm is generally not a requirement for the full lateral extent of the ribbon.

An insulative spacer, fabricated from an organic material may have a thin metallic foil or coating applied to the inner surface of an enclosure into which the spacer is formed. Extremely thin gauge coatings, in the order of 0.0125 through 0.0375 m.m. can form a gas impermeable membrane, isolated from contacting the glass pane.

The provision of a spacer material in ribbon form permits coiling of the ribbon, in an unfolded planar configuration, into rolls of extended length, elsewhere referred to as being "endless", from which portions may be readily and precisely cut to desired length to form an insulative spacer, frame-shaped seal of desired, predetermined peripheral length for a selected size of installation. The planar nature of the coiled ribbon-like spacer permits cutting of suitable notches into side panel portions of the ribbon, generally as defined by the appropriate fold lines, and the precise application of lateral bend creases, enabling the precise location of the respective corners of the peripheral frame seal.

Formation of the thus prepared ribbon into a closed or semi-closed box section then provides a peripheral seal comprising a container section within which an appropriate quantity of desiccant material may be inserted. The form of the ribbon formulation, facilitates formation of the ribbon into a precisely structured, strong section, readily capable of withstanding the lateral loads to which the window panes are subject, during assembly. The final sealing and load bearing capability of the spacer is usually supplemented by the provision of a peripheral secondary seal of polysulphide plastic which serves also to protectively isolate the subject spacer and sealant seal construction.

The material thickness and/or width of a metallic seal diaphragm may be applied such as not to constitute a thermal bridge. Ultraviolet protection may be provided by applying a surface coating pigmented with a combination of carbon black and other metallic oxides such as iron.

Superior sealing against gas leakage may be achieved, using a polyvinyl alcohol layer, applied as a coating or film, and protected against moisture degredation by a SARAN (TM) polyvinylidene Chloride layer. The Saran also can serve as a sealing and protective covering and also as a bonding agent where section faces are to be adhered to each other.

The generally closed nature of the formed section also has a self-protective function for the inner surfaces thereof, against ultra-violet degradation, in addition to the provision of other function-specific protective coatings. The box section formation facilitates the provision of corner reinforcement, comprising insertable plastic corner pieces, or L-shaped section-side reinforcements, in the frame-like seal.

The present invention further provides a method of fabricating a multi-layer window light having a plurality of panes in peripheral, hermetically sealed relation, comprising the steps of: providing an endless ribbon of predetermined width and lateral stiffness, and having at least one selected area thereof substantially gaseously non-permeable and possessing a predetermined limiting low value of edge-to-edge thermal conductivity thereacross; severing a predetermined length of the ribbon; folding the ribbon along longitudinally extending fold lines to form an elongated spacer section; jointing the ribbon length intermediate the ends thereof to form a frame-like enclosure; joining and sealing the ends of the ribbon length, to complete the enclosure; installing the enclosure in planar oriented relation as a spacer between a pair of window panes, to enclose a space between the panes, within the enclosure; and sealing the enclosure in hermetic, sealing relation with the panes, to preclude the undesired transfer of gas and vapour relative to the enclosed space. The method may further include the insertion of desiccant material within selected portions of the respective hollow sections forming the sides of the seal enclosure, including perforating the ribbon in predetermined areas, to provide breathing access between the desiccant material and the hermetically sealed space between the window panes, for the absorption of any moisture or hydrocarbon vapours that are present or that may evolve over time.

Such breathing access perforations may be drilled into an appropriate surface of the formed section, or punched out of an appropriate ribbon panel, or provided by the cutting of appropriate panel corner reliefs.

It will be understood that the presently disclosed seal may be made up into formed sections of pre-cut length, such as 7 meters. The preformed length can then be readily made up into spacer frames of a desired shape. Such spacer frames may utilize various types of corner joint in inserted relation within the section, to provide an effective window seal.

Further seal embodiments include pairs of U-sections assembled in mutual adhering relation to form closed box sections. The use of a Saran coating at the section interfaces makes possible the heat sealing of adjoining seal faces, without requiring adhesive.

BRIEF DESCRIPTION OF THE DRAWINGS

Certain embodiments of the invention are described, by way of example, without limitation of the invention thereto, reference being made to the accompanying drawings, wherein.

BEST MODE FOR CARRYING OUT THE INVENTION

Figure 1:
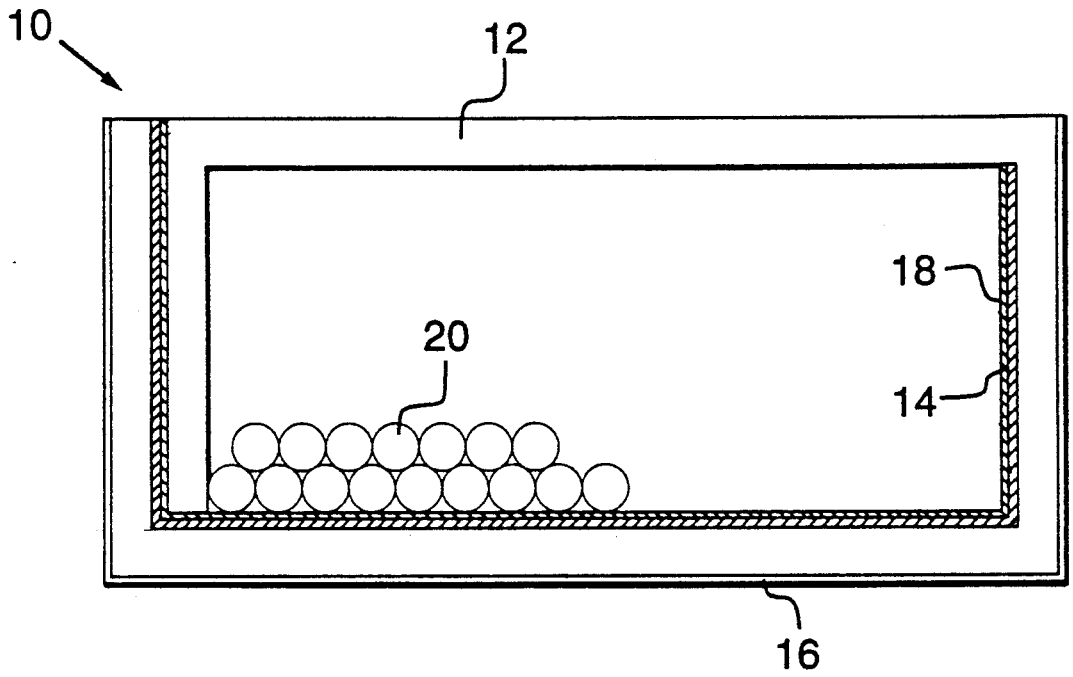
FIG. 1 is a schematic cross-section of a spacer leg made in accordance with the present invention.

Referring to the drawings, the spacer 10 shown in FIG. 1 is formed from a cardboard web 12 having a coating 14 of vinyl alcohol serving as a gas impermeable barrier on one face thereof, and an outer surface coating 16 of SARAN (TM).

A foil layer 18 on the inside of the section may be metallized paper or paper supported by foil, adhesively secured to the section. Desiccant elements 20 may be of zeolite or other suitable material, contained within the hollow section of the spacer 10.

Figure 2:
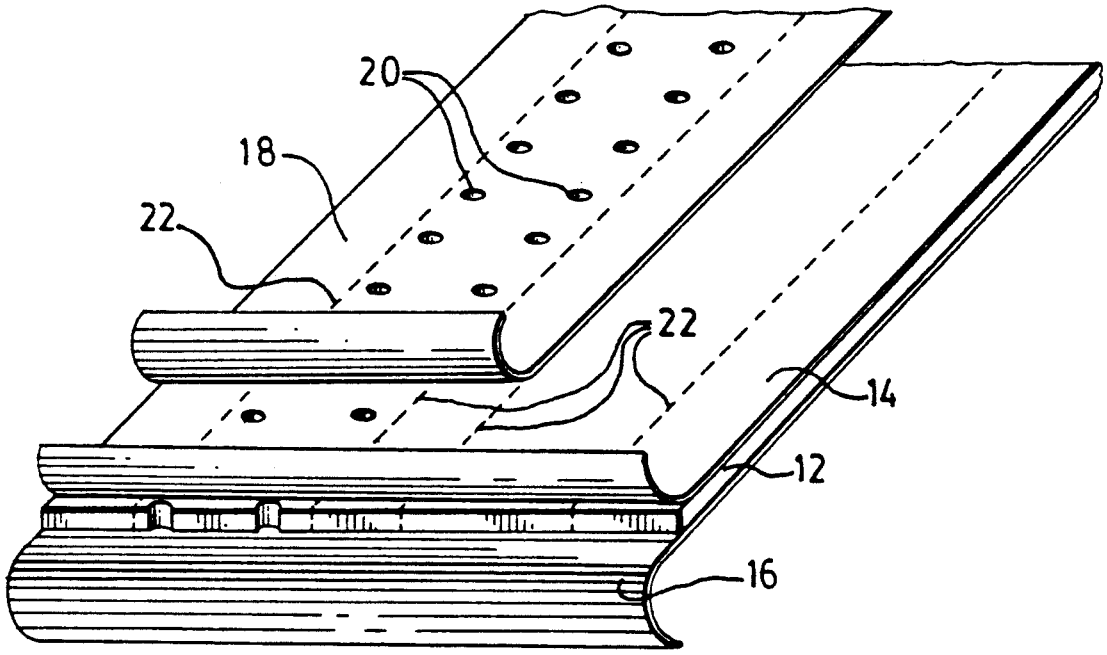
FIG. 2 is a perspective schematic view of the laminated construction of a web for the FIG. 1 spacer embodiment.

In FIG. 2 the composition of the web of spacer 10 is more particularly detailed, with the web 12 of cardboard having barrier coating 14, outer coating 16 and foil layer 18. Ventilation perforations 20 give access to the interior of section 10 from the side of the section facing the interior of the sealed cavity of the glazing panel.

Fold lines 22 may be imprinted or scored on the respective components of the spacer 10.

Figure 3:
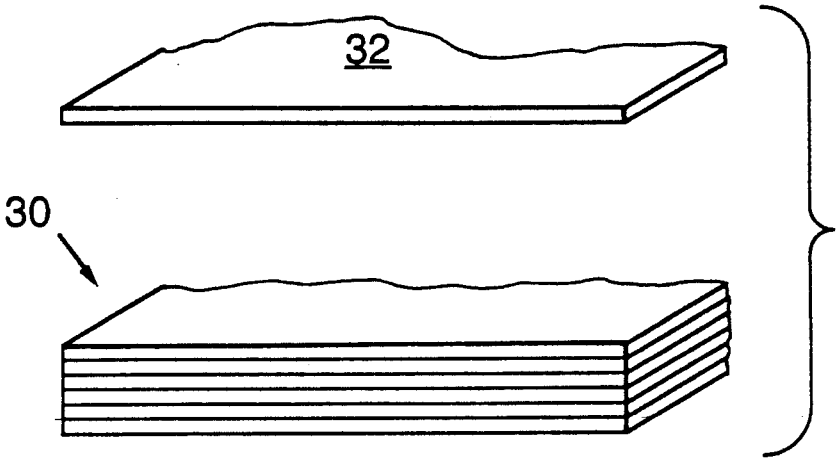
FIG. 3 is a composite partial view in perspective showing an individual lamina and a laminated web.

Referring to FIG. 3, a planar spacer ribbon 30 may be built up of a series of laminations 32, each lamination 32 being of paper or cardboard and having a coated or impregnated surface as taught above, to provide the desired sealing and/or protective characteristics.

This results in a strong, stiff hermetic seal structure. In accordance with design requirements, the spacer 30 may be creased, folded and fabricated.

Figure 4:
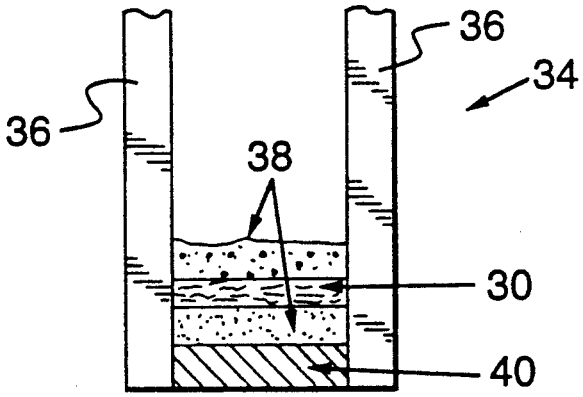
FIG. 4 is a scrap cross-section view of a portion of a 2-pane window light incorporating a simple laminated spacer/seal.

As shown in FIG. 4, a sealed glazing structure 34 has a pair of adjacent glazing panes 36 held in sealed, spaced relation by a plain spacer 30.

Adjoining mastic layers 38 may contain desiccant, and an outer seal layer 40 may comprise a reactable resinous seal material such as polysulphide which adheres to the glass panes 36 and forms a durable peripheral enclosure as both water barrier and bonding agent to secure the panes 36 in permanent laterally aligned relation.

Figure 5:
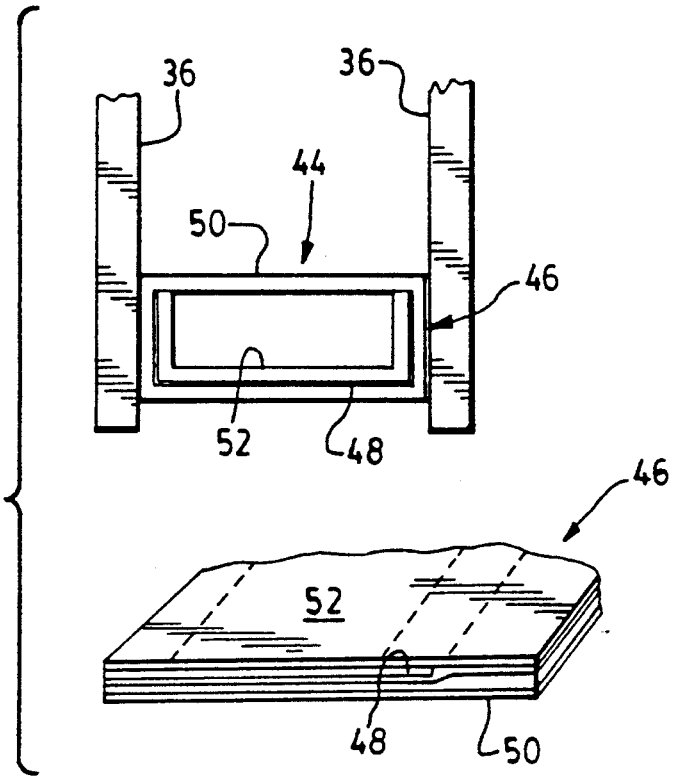
FIG. 5 is an end section of a 2-pane window light incorporating a multi-ply spacer/seal incorporating a foil lamina sandwiched therein.

Referring to FIG. 5, a folded seal/spacer 44 is formed from a laminated ribbon 46 incorporating a metal foil 48 located in a thermally isolated intermediate position between outer plies 50 and inner plies 52, as one of the plies or laminates of the ribbon 46.

Figure 6:
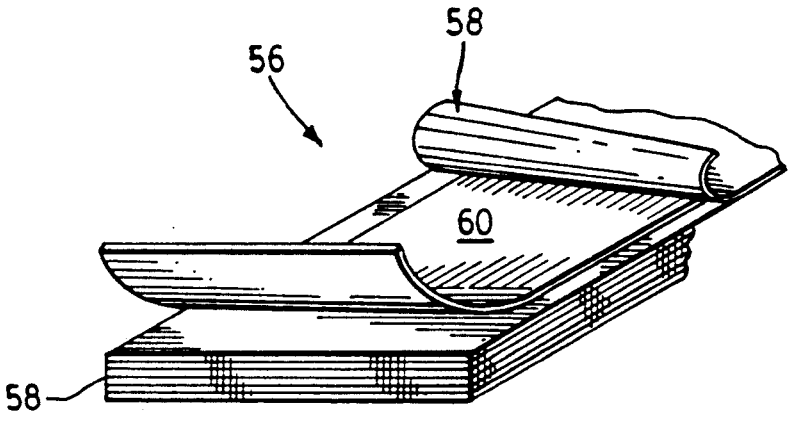
FIG. 6 is a perspective schematic view of an unformed laminated spacer with a heavy foil layer.

Referring to FIG. 6 a spacer laminated construction 56 has a plurality of paper or cardboard plies 58 to provide the requisite seal characteristics, together with a metallic foil 60 of sufficient gauge (thickness) to impart deadfold characteristics to the construction. It will be understood that the substantial metallic foil 60 may form an intermediate ply, and will certainly not be located in a position to form a glass-to-glass thermal bridge. Thus the construction 56 may be roll formed or press folded to a desired shape of section, for fabrication into a spacer frame assembly.

Figure 7:
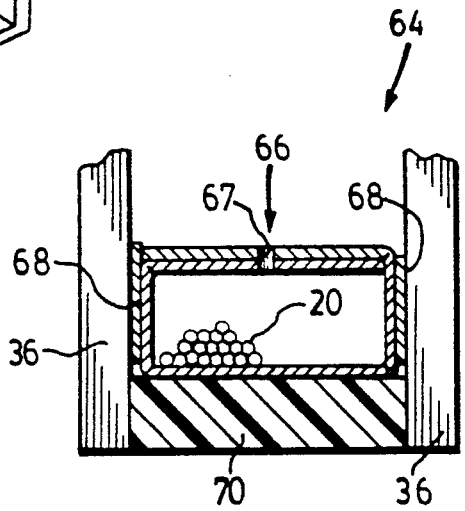
FIG. 7 is a view similar to FIG. 4, showing a spacer substantially in accordance with FIG. 1.

Referring to FIG. 7, the assembly 64 comprises a pair of glazing panes 36 having a spacer/seal assembly 66 therebetween. The seal assembly 66 comprises a 5-panel ribbon having the side panels and underlying panels thereof hermetically sealed, as described above, the two upper panels being in mutual adherent relation, to provide the requisite structural strength. Ventilation apertures 67 connect the sealed interior with the seal space, containing desiccant particles 20. Primary seals 68 (such as polyisobutylene) adhere and seal the side panels of seal assembly 66 to the inner surfaces of the glazing panes 36. A secondary seal 70, generally of polysulfide, lends additional mechanical strength, mechanical protection and sealing back-up to the primary seal assembly 66.

Figure 8:
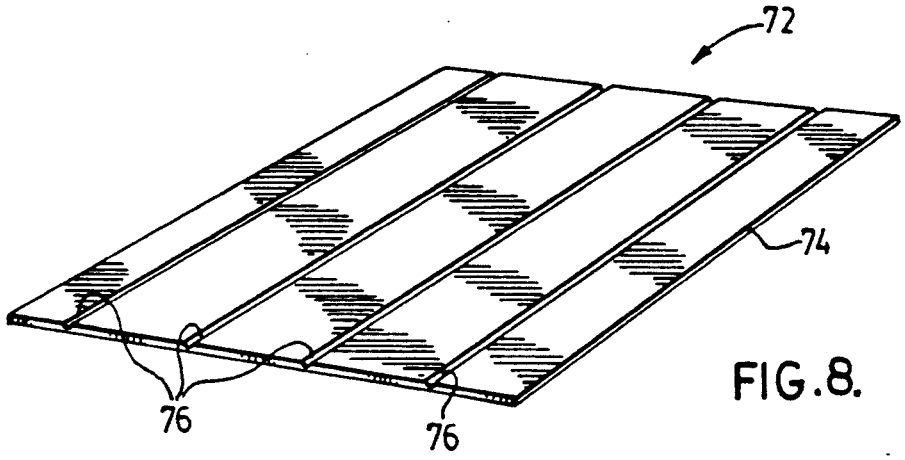
FIG. 8 is a perspective view of a portion of a laminated spacer construction incorporating fold scores.

Turning to FIG. 8, a portion of ribbon 72, is illustrated as being of a single thickness. The substrate 74 may have appropriate seals, as described above impregnated into it, or laminated thereto. Indented fold lines 76 delineate the respective panels, and facilitate folding of the ribbon 72 into its box section.

Figure 9A:
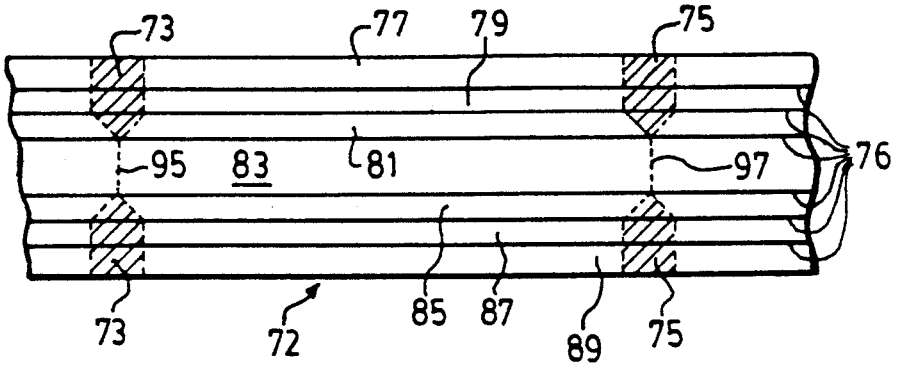
FIG. 9A is a plan view of a scored length of laminated ribbon according to the invention showing lateral cut-and-fold lines to form corners.
Figure 9B:
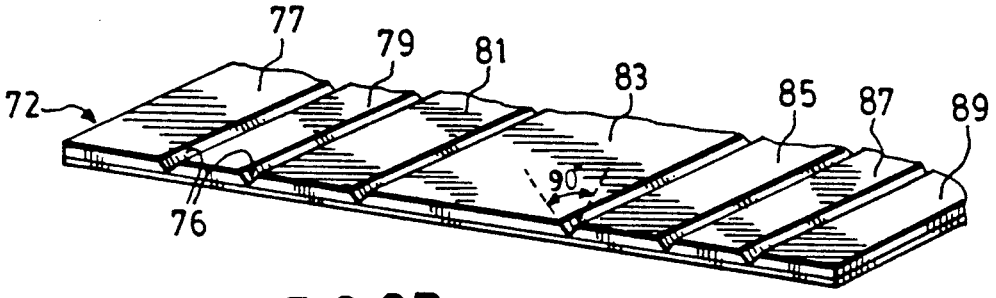
FIG. 9B is a perspective view of an end of the FIG. 9A ribbon.

FIG. 9A, viewed in association with FIGS. 9B through 9E, shows the progression from a ribbon 72 of 7-panels to a portion of a folded, peripheral seal, including corner joints, and the associated angled reinforcements therefor. The ribbon 72, has indented lengthwise fold lines 76 which may be scored with an included angle of 90°, to stabilize the joints so formed when the ribbon 72 is laterally folded. The six fold lines 76 define longitudinal panels 77, 79, 81, 83, 85, 87 and 89.

Figure 9C:
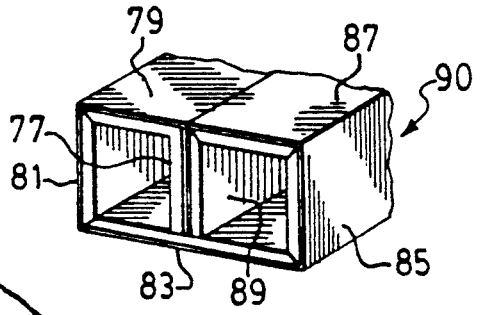
FIG. 9C is a perspective end view of the FIG. 9B ribbon in folded spacer form.

Folding of these longitudinal panels as shown, forms the double-section 90 of FIG. 9C. Prior to folding the ribbon 72, the cross-hatched strike-out areas 73, 75 may be removed by cut-out or punching in order to create corners 92,94 (FIG. 9A). In the illustrated embodiment, FIG. 9D, it will be appreciated that the distance between corners 92,94 (and fold lines 95,97 in FIG. 9A) has been greatly foreshortened, for purposes of illustration, while the size of the ribbon and folded section has been exagerated.

Figure 9D:
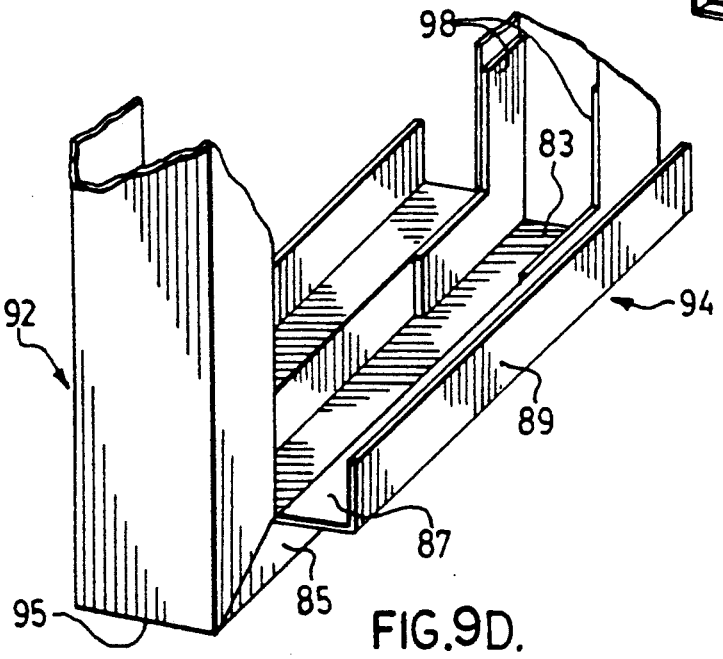
FIG. 9D is a perspective view in partially unfolded relation showing corner construction of a rectangular spacer; and, FIG. 9E is a perspective view of a corner reinforcement angle for the FIG. 9D construction.
Figure 9E:
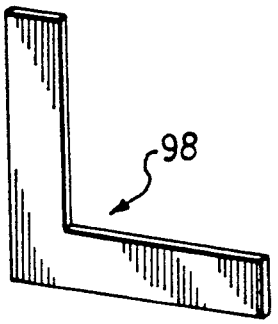

In FIG. 9D right-angled reinforcement pieces 98, also shown in FIG. 9E are included in the fabricated circles 92,94. The pieces 98 may be glued into place, and may be of plastic or cardboard.

It will be understood that solid angle pieces of cast plastic, or other suitable internal corner reinforcements may be used.

Figure 10:
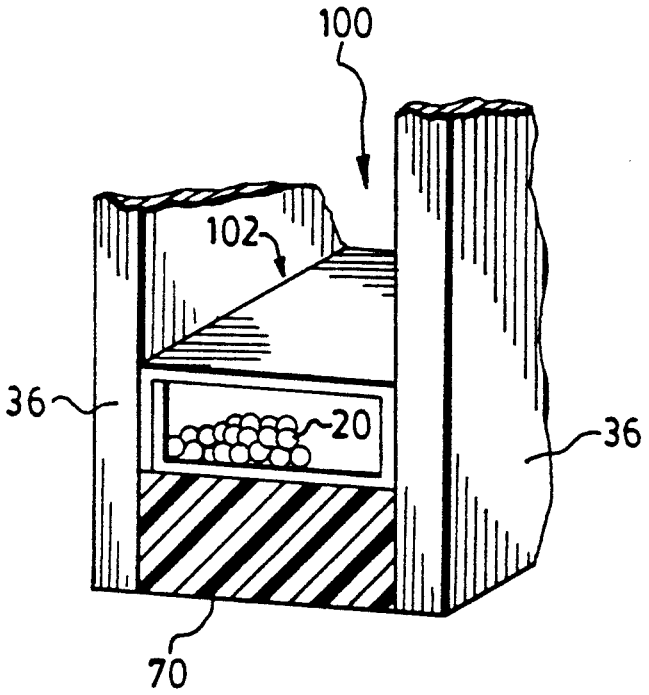
FIG. 10 is a perspective view of an end portion of a 2-pane window light incorporating a laminated seal embodiment in accordance with the present invention.

FIG. 10 shows a portion of a glazing assembly 100 having a seal arrangement akin to that of FIG. 1, with glazing panes 36, a seal assembly 102 containing desiccant particles 20, and a secondary seal 70.

Figure 11:
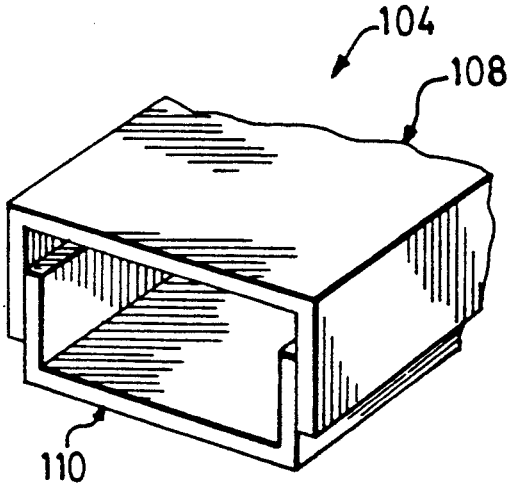
FIGS. 11 and 12 are perspective views of two 2-piece folded laminated seal embodiments in accordance with the invention.
Figure 12:
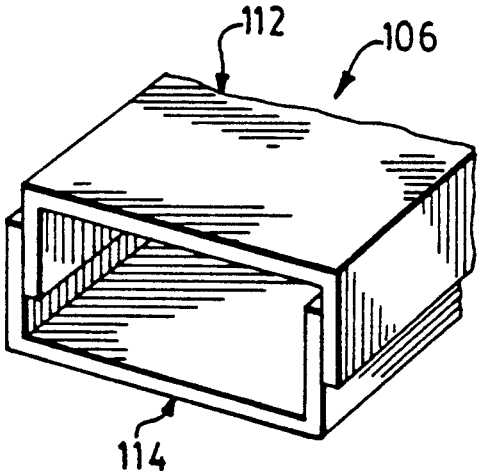

FIGS. 11 and 12 show two-piece seal embodiments 104 and 106 respectively. The FIG. 11 embodiment 104 has an upper, outer seal half 108 of inverted U-form and a lower, inner seal half 110, glued or bonded thereto.

Figure 13:
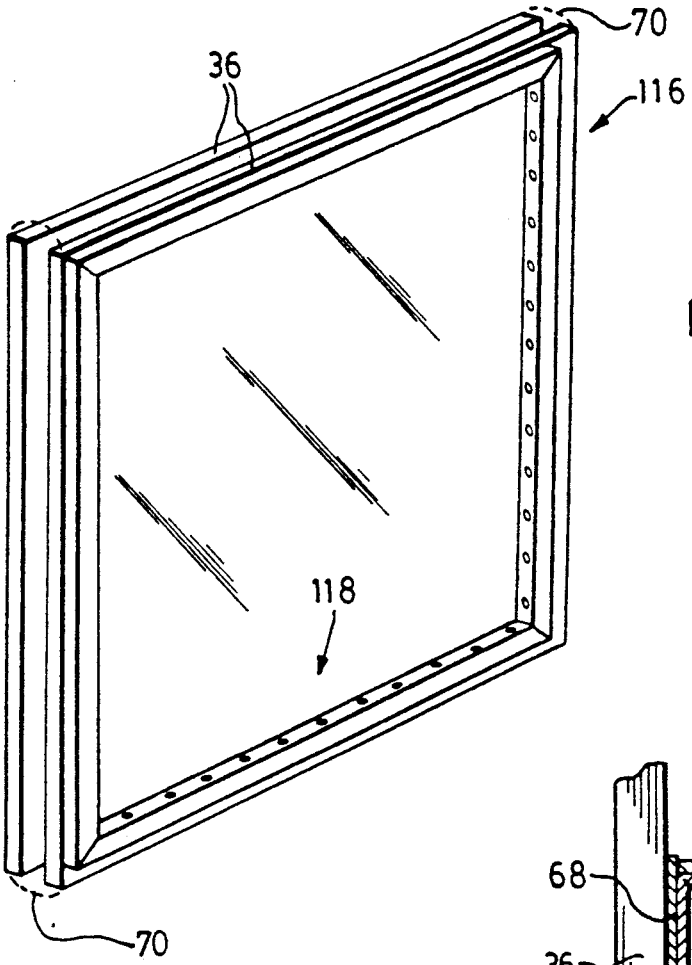
FIG. 13 is a perspective view of a glazing unit incorporating a spacer/seal in accordance with the invention.

In the FIG. 12 embodiment an upper inverted U-section seal half 112 and a lower seal half 114 of substantially similar dimensions and reversed form are secured in mutually sealed, enclosing and overlapped relation. Referring to FIG. 13 a window arrangement 116 according to the present invention comprises a pair of glazing panes 36 having a spacer/seal frame 118 enclosing a sealed-off hollow zone between the panes 36. An outer peripheral secondary seal 70 of polysulfide, shown in dotted profile, completes the window light assembly.

INDUSTRIAL APPLICABILITY

Glazing units incorporating the presently disclosed sealing system possess high efficiency and are suited for a wide range of domestic and commercial use for both doors, window and skylights.

What is claimed:

1. In combination, a sealed multilayer glazing panel having at least a pair of glazing panes and an elongated insulating ribbon seal having a fibrous web portion, located in space enclosing sealing relation between said pair of glazing panes, said panes being held in mutually parallel, spaced apart relation, said seal being located adjacent the edges of said panes and having said seal ribbon fibrous web portion extending in secured spacing relation between said glazing panes; said ribbon having a coherent, substantially permeable surface with a hermetic sealing layer of substantially totally gas impermeable material covering at least the span between said panes in hermetic sealing, substantially thermally nonconductive space-enclosing relation therebetween.

2. The combination as set forth in claim 1, said ribbon seal comprising a plurality of laminations.

3. The combination as set forth in claim 1, said ribbon having lateral compressive stiffness sufficient to maintain said glazing panes in stable, spaced apart relation.

4. The combination as set forth in claim 1, said hermetic sealing layer being laminated to said fibrous web.

5. The combination as set forth in claim 1, said fibrous web being at least partially permeated by said sealing layer.

6. The combination as set forth in claim 1, having a plurality of layers in mutually laminated adherent relation.

7. The combination as set forth in claim 6, said plurality of layers including a layer of foil extending at least partially laterally of said ribbon to form a lamination of said ribbon extending along a longitudinally extending panel portion of said ribbon.

8. The combination as set forth in claim 7, said foil layer being located in laminated relation with adjoining layers of said ribbon.

9. The combination as set forth in claim 1, said combination including a secondary-seal located outwardly of said ribbon seal in lateral spacing relation with said panes.

10. The combination as set forth in claim 1, said ribbon having a thickness sufficient in use to hold said panes in substantially constant, spaced apart relation.

11. The combination as set forth in claim 10, said seal including a gas permeable enclosure for the location of a dessicant material within the enclosure.

12. The combination as set forth in claim 11, said sealing means permeable enclosure including a desiccant filler therein.

13. The combination as set forth in claim 1, said seal having a plurality of longitudinal fold lines on one face thereof.

14. The combination as set forth in claim 13, said longitudinal lines defining therebetween a plurality of longitudinally extending panels, foldable in use into a non-planar section seal.

15. The combination as set forth in claim 14, said section seal comprising a substantially closed section.

16. The combination as set forth in claim 13, said foldable panels forming a substantially closed section comprising a plurality of compartments in mutual laterally adjoining relation between said panes.

17. The combination as set forth in claim 7, said foil layer extending across substantially the width of said ribbon, said foil being of sufficient thickness and of substantially non-resilient material to impart deadfold characteristics to said ribbon.

18. The combination as set forth in claim 14, at least one of said panels including a plurality of perforations therein, in use to provide communicating passages connecting the hollow interior enclosed between said glazing panes with the hollow interior of said non-planar seal.

19. The combination as set forth in claim 1, said hermetic layer including isopropyl alcohol.

20. The combination as set forth in claim 1, said hermetic layer including SARAN (TM).

21. The combination as set forth in claim 2, at least one said lamination comprising said fibrous web portion and isopropyl alcohol.

22. The combination as set forth in claim 2, at least one said lamination comprising said fibrous web portion and SARAN (TM).

23. The combination as set forth in claim 1, said ribbon seal including an ultra-violet-resistant component as a laminate of said web portion.

24. The combination as set forth in claim 23, said ultra-violet-resistant component comprising a coating on a face portion of said web.

25. The combination as set forth in claim 14, said plurality of longitudinally extending panels exceeding four in number, and providing, when folded into a spacer a substantially rectangular closed section, as a closed rectangular frame.

26. The combination as set forth in claim 25, said closed section containing desiccant material in inserted relation therein.

27. The combination as set forth in claim 15, assembled in use as a closed rectangular frame of hollow section, including corner reinforcement means within the corners of said rectangular frame.

28. The combination as set forth in claim 15, having closed rectangular frame of hollow section, said hollow section comprising two U-sections in facing, overlapping relation.

29. The combination as set forth in claim 28, one said U-section fitting within the other of said U-sections.

30. The combination as set forth in claim 28, one said U-section being off-set in opposed relation with the other of said U-sections.

* * * * *